US009644341B2

(12) United States Patent
Yoshimura et al.

(10) Patent No.: US 9,644,341 B2
(45) Date of Patent: May 9, 2017

(54) MOTOR GRADER

(71) Applicant: KOMATSU LTD., Tokyo (JP)

(72) Inventors: Masashi Yoshimura, Komatsu (JP); Yutaka Ono, Komatsu (JP); Shintaro Kobayashi, Komatsu (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/781,442

(22) PCT Filed: Jun. 17, 2013

(86) PCT No.: PCT/JP2013/066607
§ 371 (c)(1),
(2) Date: Sep. 30, 2015

(87) PCT Pub. No.: WO2014/203309
PCT Pub. Date: Dec. 24, 2014

(65) Prior Publication Data
US 2016/0024750 A1 Jan. 28, 2016

(51) Int. Cl.
*E02F 3/76* (2006.01)
*E02F 3/84* (2006.01)

(52) U.S. Cl.
CPC ..... *E02F 3/7668* (2013.01); *E02F 3/764* (2013.01); *E02F 3/765* (2013.01); *E02F 3/7645* (2013.01); *E02F 3/7654* (2013.01); *E02F 3/844* (2013.01)

(58) Field of Classification Search
CPC ..... E02F 3/7668; E02F 3/844; E02F 3/764; E02F 3/765; E02F 3/7645; E02F 3/7654;
(Continued)

(56) References Cited

U.S. PATENT DOCUMENTS 1,841,403 A * 1/1932 Dean ..... E02F 3/844 172/796
2,323,108 A * 6/1943 Arndt ..... E02F 3/764 172/667

(Continued)

FOREIGN PATENT DOCUMENTS

CN 2357047 Y 1/2000
CN 201671125 U 12/2010

(Continued)

OTHER PUBLICATIONS

The International Search Report for the corresponding international application No. PCT/JP2013/066607, issued on Aug. 20, 2013.

(Continued)

*Primary Examiner* — Robert Pezzuto
*Assistant Examiner* — Adam Behrens
(74) *Attorney, Agent, or Firm* — Global IP Counselors, LLP

(57) ABSTRACT

A circle rotator of a motor grader includes a worm, a worm wheel and a shaft. The worm wheel has an inner peripheral portion, an outer peripheral portion enclosing the inner peripheral portion from outside, and a plurality of first clutch discs to be spline-coupled to the inner peripheral surface of the inner peripheral portion. The inner peripheral portion is made of a material harder than a material of which the outer peripheral portion is made.

11 Claims, 6 Drawing Sheets

(58) Field of Classification Search
CPC .. E02F 3/6454; E02F 3/64; F16D 7/00; F16D 7/024; F16D 7/025; F16D 7/027
See application file for complete search history.

(56) References Cited

U.S. PATENT DOCUMENTS

| | | | | | |
|---|---|---|---|---|---|
| 2,928,381 | A * | 3/1960 | MacDonald | E02F 3/7627 | 172/796 |
| 4,004,641 | A * | 1/1977 | Hendrickson | E02F 9/24 | 172/103 |
| 4,025,336 | A * | 5/1977 | Suwa | C22C 9/01 | 148/436 |
| 4,122,903 | A * | 10/1978 | Cole | E02F 3/764 | 172/747 |
| 4,560,054 | A * | 12/1985 | Kayanoki | F16F 15/12366 | 192/204 |
| 5,296,057 | A * | 3/1994 | Baba | C22C 9/01 | 148/436 |
| 5,975,271 | A * | 11/1999 | Iwata | F16D 3/06 | 192/200 |
| 6,851,485 | B2 * | 2/2005 | Maeda | E02F 3/764 | 172/781 |
| 8,746,362 | B2 * | 6/2014 | Bindl | E02F 3/764 | 172/781 |
| 2004/0149463 | A1 * | 8/2004 | Maeda | E02F 3/764 | 172/297 |
| 2012/0073890 | A1 * | 3/2012 | Bindl | E02F 3/764 | 180/69.6 |
| 2014/0251648 | A1 * | 9/2014 | Staade | E02F 3/7668 | 172/796 |
| 2015/0033892 | A1 * | 2/2015 | Casamenti | F16D 7/027 | 74/425 |

FOREIGN PATENT DOCUMENTS

| | | | |
|---|---|---|---|
| CN | 201953956 | U | 8/2011 |
| JP | 53-8003 | U | 3/1973 |
| JP | 50-117602 | U | 9/1975 |
| JP | 4-138451 | U | 12/1992 |
| JP | 5-40350 | U | 6/1993 |
| JP | 11-93971 | A | 4/1999 |
| JP | 2004-190232 | A | 7/2004 |
| JP | 2005-207586 | A | 8/2005 |
| JP | 2007-143468 | A | 6/2007 |
| JP | 2010-187638 | A | 9/2010 |

OTHER PUBLICATIONS

The Office Action for the corresponding Japanese application No. 2015-522386 dated Jul. 26, 2016.
The Office Action for the corresponding Chinese application No. 201380075543.3 dated Aug. 22, 2016.

* cited by examiner

MOTOR GRADER

CROSS-REFERENCE TO RELATED APPLICATIONS

This application is a U.S. National stage application of International Application No. PCT/JP2013/066607, filed on Jun. 17, 2013.

BACKGROUND

Field of the Invention

The present invention relates to a motor grader equipped with a blade pivoting device.

Background Information

Motor graders include a frame, a drawbar supported beneath the frame capable of pitching up and down, a blade pivoting device supported by the drawbar, and a blade supported by the blade pivoting device (e.g., see Japan Laid-open Patent Application Publication No. 2004-190232). The blade pivoting device includes a circle for supporting the blade and a circle rotator for driving and rotating the circle. The circle rotator is disposed on the drawbar.

SUMMARY

Since the circle rotator is disposed on the drawbar, it is required to extend the interval between the circle rotator and the frame for extending the range of rising motion of the blade, and hence, it is demanded to lower the height of the circle rotator.

The present invention has been produced in view of the aforementioned situation, and it is an object of the present invention to provide a motor grader in which the height of a circle rotator can be lowered.

A motor grader according to a first aspect of the present invention includes a frame, a drawbar, a blade pivoting device and a blade. The drawbar is disposed beneath the frame and is supported by the frame to be capable of pitching up and down. The blade pivoting device is supported by the drawbar. The blade is supported by the blade pivoting device. The blade pivoting device includes a circle, which supports the blade and is rotatably attached to the drawbar, and a circle rotator configured to rotary drive the circle. The circle rotator includes a worm, a worm wheel meshed with the worm, and a shaft inserted through the worm wheel. The worm wheel includes an inner peripheral portion enclosing the shaft, an outer peripheral portion, which encloses the inner peripheral portion from outside and is meshed with the worm, and a plurality of first clutch discs spline-coupled to an inner peripheral surface of the inner peripheral portion. The shaft includes a shaft body and a plurality of second clutch discs that are spline-coupled to an outer peripheral surface of the shaft body and each of which is interposed between the plural first clutch discs. The inner peripheral portion is made of a material harder than a material of which the outer peripheral portion is made.

According to the motor grader of the first aspect of the present invention, the inner peripheral portion is made of the hard material. Hence, surface pressure resistance can be enhanced for contact surfaces of the first clutch discs and the inner peripheral portion to which the first clutch discs are spline-coupled. Therefore, the first clutch discs can be reduced in thickness and in number. Hence, the circle rotator can be reduced in entire height. As a result, the interval between the circle rotator and the frame can be extended, and hence, the range of rising motion of the blade can be extended.

A motor grader according to a second aspect of the present invention relates to the motor grader according to the first aspect, and wherein the outer peripheral portion has an outer peripheral portion body enclosing the inner peripheral portion from outside and a thrust receiver that inwardly extends from the outer peripheral portion body and is disposed beneath the inner peripheral portion. The shaft has a contact portion that outwardly extends from the shaft body and is disposed beneath the thrust receiver.

According to the motor grader of the second aspect of the present invention, the thrust receiver made of the soft material is contacted to the contact portion to be capable of receiving a thrust load. Hence, galling and adhesion of the contact portion to the thrust receiver can be inhibited.

A motor grader according to a third aspect of the present invention relates to the motor grader according to the first or second aspect, and wherein the inner peripheral portion has an inner peripheral portion body having an annular plate shape and a bulging part outwardly and downwardly bulging from the inner peripheral portion body. The outer peripheral portion has a first part covering an upper end of the bulging part from above and a second part covering a lower end of the bulging part from inside.

According to the motor grader of the third aspect of the present invention, when the inner peripheral portion is fixed to the interior of a mold and then a melting material is poured into the mold, a gap can be inhibited from being produced in the surrounding of the bulging part.

A motor grader according to a fourth aspect of the present invention relates to the motor grader according to the third aspect, and wherein on a cross-section of the inner peripheral portion taken along a plane on which a center axis of the shaft passes, a first outer edge line indicating an outer peripheral edge of the inner peripheral portion body and a second outer edge line indicating a lower edge of the inner peripheral portion body are roughly symmetric to each other with respect to a reference line passing through a middle of the first outer edge line and the second outer edge line. A width of the inner peripheral portion body along a direction orthogonal to the reference line gradually decreases toward the bulging part A width of the bulging part along the direction orthogonal to the reference line gradually increases oppositely to the inner peripheral portion body.

According to the motor grader of the fourth aspect of the present invention, a binding force can be enhanced between the inner peripheral portion and the outer peripheral portion by narrowing the inner peripheral portion at a boundary between the inner peripheral portion body and the bulging part.

A motor grader according to a fifth aspect of the present invention relates to the motor grader according to any of the first to fourth aspects, and wherein the inner peripheral portion is made of cast iron.

A motor grader according to a sixth aspect of the present invention relates to the motor grader according to any of the first to fifth aspects, and wherein the outer peripheral portion is made of copper-aluminum alloy.

According to the exemplary embodiments of the present invention, it is possible to provide a motor grader in which the height of a circle rotator can be lowered.

DETAILED DESCRIPTION OF EXEMPLARY EMBODIMENTS

Entire Construction of Motor Grader 100

Figure 1:
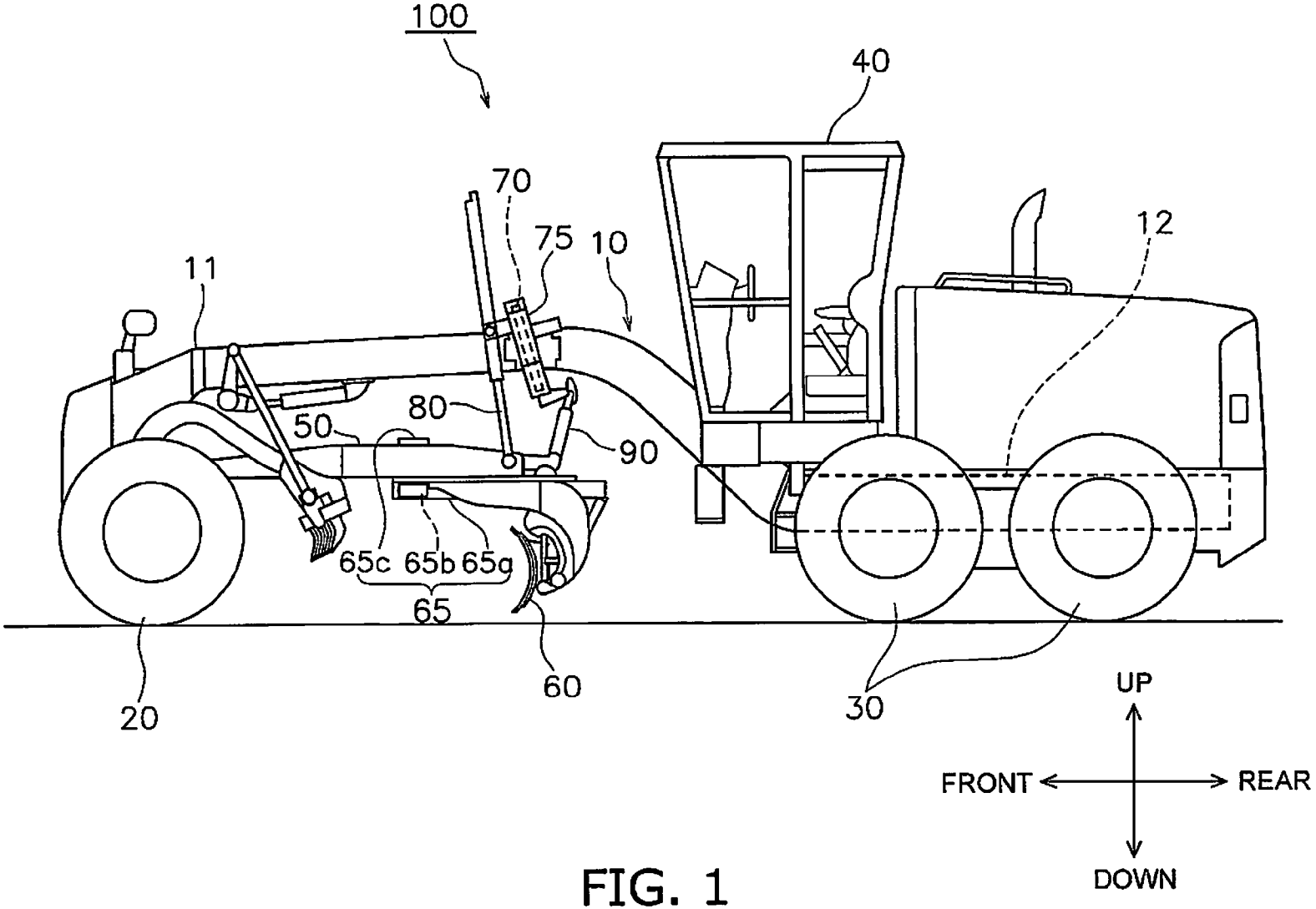
FIG. 1 is a side view of an entire construction of a motor grader.
Figure 2:
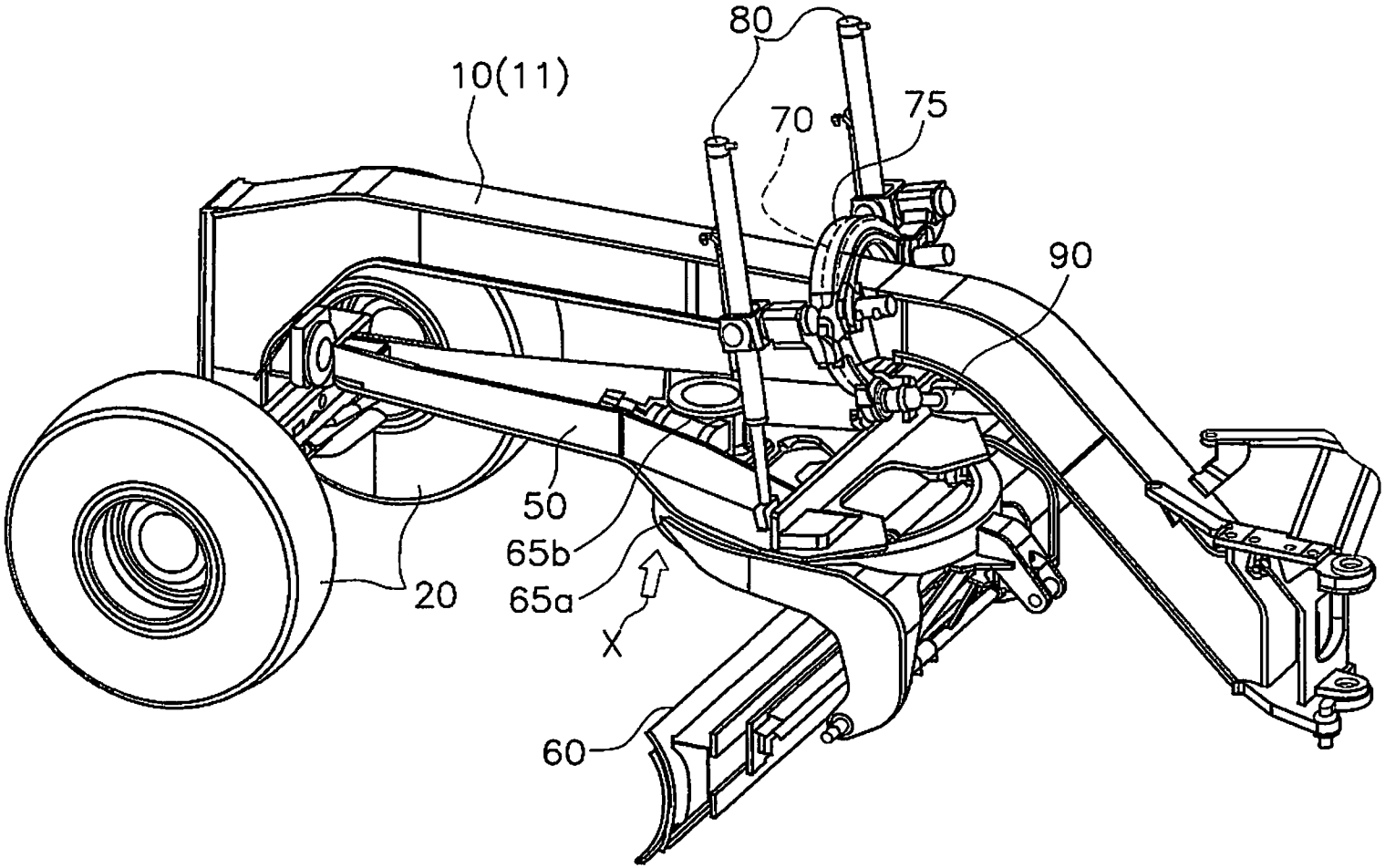
FIG. 2 is an enlarged perspective view of a front part of the motor grader.
Figure 3:
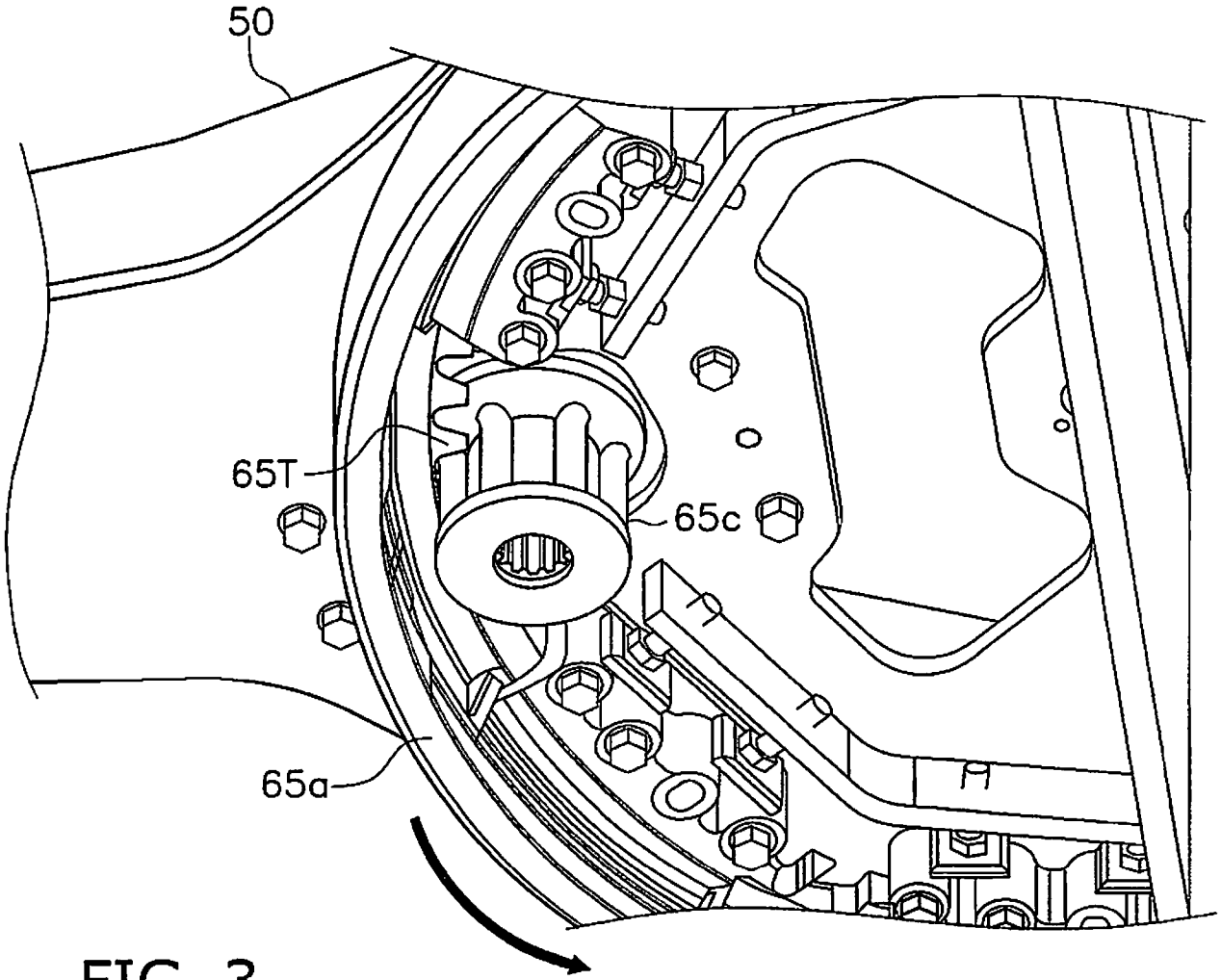
FIG. 3 is a perspective view of a blade pivoting device.

FIG. 1 is a side view of an entire construction of a motor grader 100. FIG. 2 is an enlarged perspective view of a front part of the motor grader 100. FIG. 3 is a perspective view of a blade pivoting device 65 seen in a direction X in FIG. 2. It should be noted that in the following explanation, "up", "down", "left", "right", "front" and "rear" are terms defined on the basis of a direction seen from an operator seated on an operator seat.

The motor grader 100 includes a frame 10, front wheels 20, rear wheels 30, a cab 40, a drawbar 50, a blade 60, the blade pivoting device 65, a lifter guide 70, a lifter bracket 75, a pair of lift cylinders 80, and a shift cylinder 90.

The frame 10 is composed of a front frame 11 and a rear frame 12. The front frame 11 supports the drawbar 50 at the front end thereof. The rear frame 12 supports an engine, a hydraulic pump and so forth (not shown in the drawings).

The front wheels 20 are attached to the front end of the front frame 11. The rear wheels 30 are attached to the rear frame 12. The cab 40 is disposed on the front frame 11. The cab 40 may be disposed on the rear frame 12.

The drawbar 50 is disposed beneath the front frame 11. The drawbar 50 is supported by the front end of the front frame 11 to be capable of pitching up and down. The blade 60 is supported by the blade pivoting device 65.

The blade pivoting device 65 is supported by the rear end of the drawbar 50. The blade pivoting device 65 includes a circle 65*a*, a circle rotator 65*b* and a pinion 65*c*. The circle 65*a* is rotatably supported by the rear end of the drawbar 50. The circle 65*a* supports the blade 60. The circle rotator 65*b* is disposed inside the circle 65*a*. The circle rotator 65*b* is configured to rotary drive the circle 65*a* by hydraulic pressure. Specifically, as shown in FIG. 3, the pinion 65*c* coupled to the lower end of the circle rotator 65*b* is meshed with internal teeth 65T of the circle 65*a*. Thus, the circle 65*a* is configured to be rotated in conjunction with rotation of the pinion 65*c*. The construction of the circle rotator 65*b* will be described below.

It should be noted in the present exemplary embodiment, as shown in FIG. 1, the upper end of the blade pivoting device 65 upwardly protrudes from the drawbar 50, but may be designed not to protrude from the drawbar 50.

The lifter guide 70 is fixed to the frame 10. The lifter guide 70 has an annular shape. The lifter bracket 75 is a frame enclosing the lifter guide 70. The pair of lift cylinders 80 and the shift cylinder 90 are coupled to the lifter bracket 75. The pair of lift cylinders 80 is coupled to the drawbar 50 and the lifter bracket 75. When the pair of lift cylinders 80 is extended and contracted, the drawbar 50 can be moved up and down. The shift cylinder 90 is coupled to the drawbar 50 and the lifter bracket 75. When the shift cylinder 90 is extended and contracted, the drawbar 50 can be moved right and left.

Construction of Circle Rotator 65*b*

Figure 4:
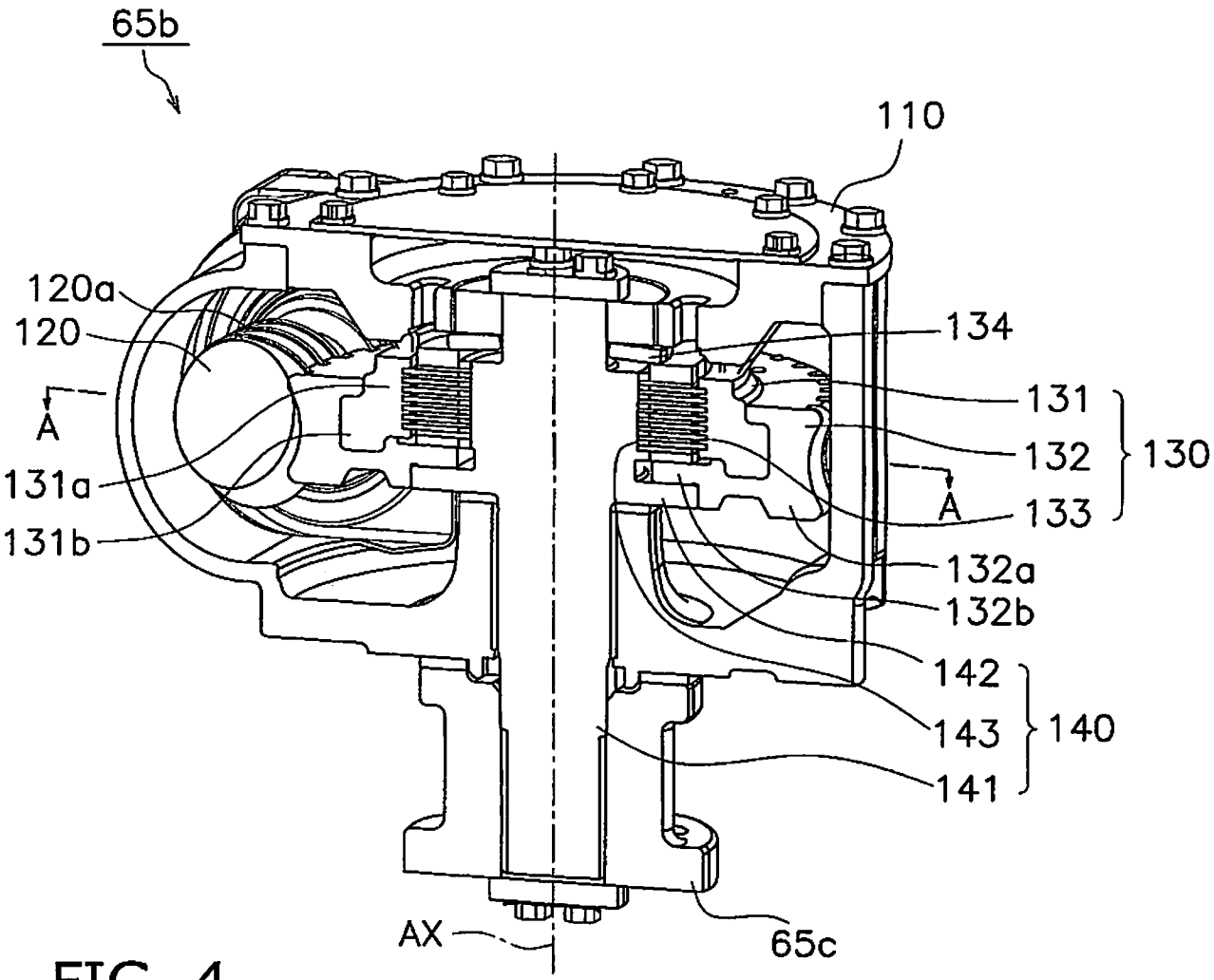
FIG. 4 is a cross-sectional view of a circle rotator.
Figure 5:
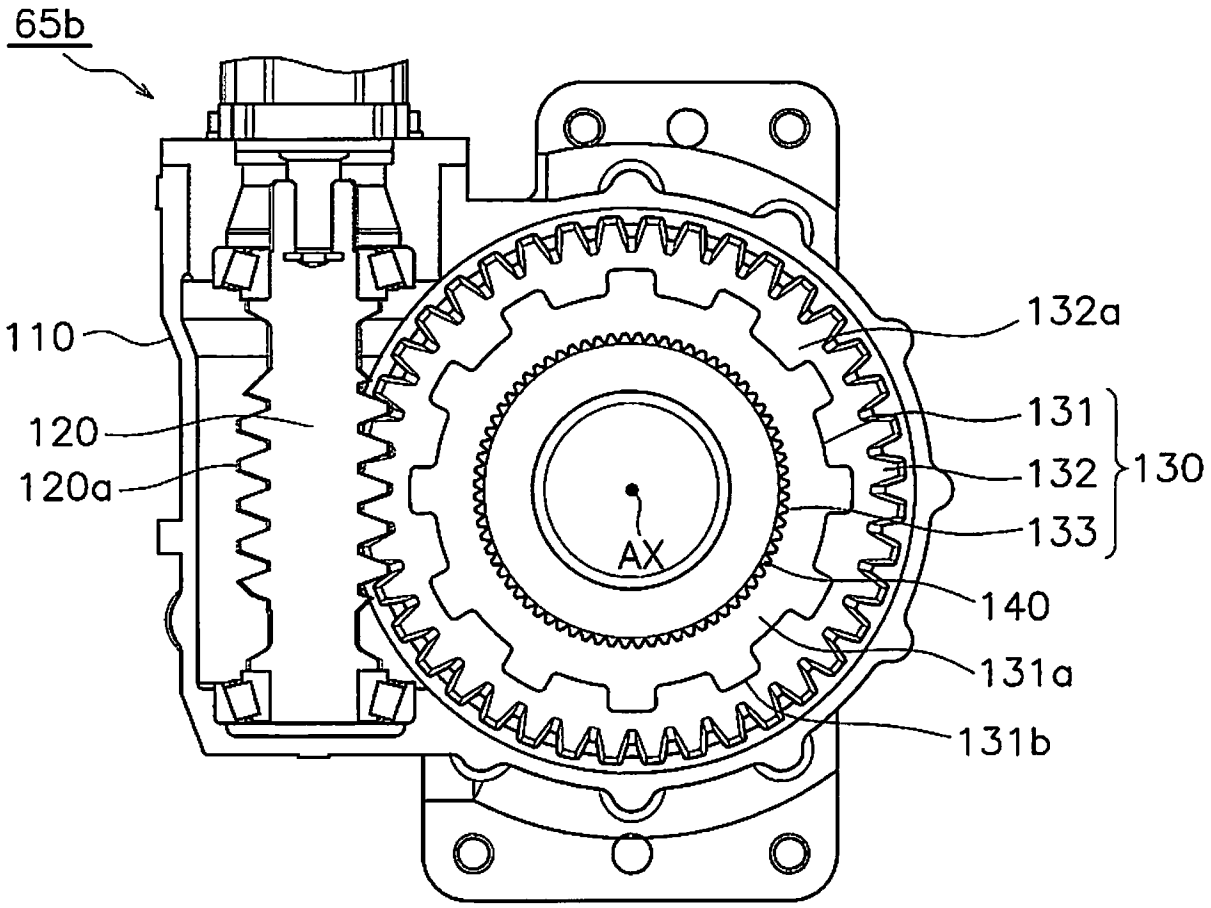
FIG. 5 is a cross-sectional view of FIG. 4 taken along line A-A.

FIG. 4 is a cross-sectional view of the circle rotator 65*b*. FIG. 5 is a cross-sectional view of FIG. 4 taken along line A-A. FIG. 4 shows a cross section taken along a vertical direction, whereas FIG. 5 shows a cross section taken along a horizontal direction. It should be noted that in the following explanation, "inward" and "outward" are terms defined on the basis of a center axis AX of a shaft 140.

The circle rotator 65*b* includes a chassis 110, a worm 120, a worm wheel 130 and the shaft 140.

The chassis 110 accommodates the worm 120 and the worm wheel 130. The worm 120 is a cylindrical member to be disposed along the horizontal direction. The worm 120 is rotary driven by hydraulic pressure. The worm 120 has screw threads 120*a* on the outer peripheral surface thereof.

The worm wheel 130 has an inner peripheral portion 131, an outer peripheral portion 132 and a plurality of first clutch discs 133.

The inner peripheral portion 131 encloses the shaft 140. The inner peripheral portion 131 is made of a material harder than a material of which the outer peripheral portion 132 is made. The material of which the inner peripheral portion 131 is made is preferably FCD450 (Ferrum Casting Ductile: the hardness thereof is, for instance, HB200), but is not limited to this.

The inner peripheral portion 131 has an inner peripheral portion body 131*a* and a plurality of bulging parts 131*b*. The inner peripheral portion body 131*a* has an annular plate shape. The plural bulging parts 131*b* outwardly and downwardly bulge from the inner peripheral portion body 131*a* toward the interior of the outer peripheral portion 132. With the construction, the inner peripheral portion 131 is firmly coupled to the outer peripheral portion 132. Accordingly, radial load resistance about the center axis AX is enhanced. It should be noted that in the present exemplary embodiment, twelve bulging parts 131*b* are provided, but the number and the size of the bulging parts 131*b* can be arbitrarily changed.

The outer peripheral portion 132 encloses the inner peripheral portion 131 from outside. The outer peripheral portion 132 is integrally formed with the inner peripheral portion 131 by casting. Specifically, the outer peripheral portion 132 is formed by fixing the inner peripheral portion 131 to the interior of a mold and then pouring a melting material into the mold. The outer peripheral portion 132 is made of the material softer than the material of which the inner peripheral portion 131 is made. The material of which the outer peripheral portion 132 is made is preferably copper-aluminum alloy (the hardness thereof is, for instance, HB160), but is not limited to this.

The outer peripheral portion 132 has an outer peripheral portion body 132*a* and a thrust receiver 132*b*. The outer peripheral portion body 132*a* has an annular shape. The thrust receiver 132*b* inwardly extends from the lower end of the outer peripheral portion body 132*a*. The thrust receiver 132*b* covers the bulging parts 131*b* from below. The thrust receiver 132*b* has an annular plate shape. The thrust receiver 132*b* is disposed beneath the inner peripheral portion 131.

An axial thrust load along the center axis AX of the shaft 140 is receivable by the thrust receiver 132*b*. The thrust receiver 132*b* is contacted to a contact portion 140*b* of the shaft 140 to be described. The thrust receiver 132*b* is made of the soft material such as copper-aluminum alloy, and hence, galling of the thrust receiver 132*b* against the contact portion 140*b* is inhibited.

The plural first clutch discs 133 respectively have an annular plate shape. The plural first clutch discs 133 are spline-coupled to the inner peripheral surface of the inner peripheral portion 131 (specifically, the inner peripheral portion body 131*a*). The plural first clutch discs 133 are disposed at predetermined intervals in the axial direction. The first clutch discs 133 are interposed among second clutch discs 143 to be described. The first clutch discs 133 are firmly united to the second clutch discs 143 by a friction force generated therebetween. Moreover, the first clutch discs 133 and the second clutch discs 143 are pressed by an urging member (disc spring) 134. When a radial load of a predetermined value or greater (a resistive force acting on the blade 60) acts on the shaft 140, the worm wheel 130 is protected by sliding the first clutch discs 133 against the second clutch discs 143. In the present exemplary embodiment, eight first clutch discs 133 are provided. However, the number, the thickness and so forth of the first clutch discs 133 can be arbitrarily changed.

The shaft 140 is inserted through the worm wheel 130. The shaft 140 is supported by the chassis 110 to be rotatable about the center axis AX. The shaft 140 is made of a material harder than the material of which the inner peripheral portion 131 is made. The material of which the shaft 140 is made is preferably a steel material, but is not limited to this. The shaft 140 includes a shaft body 141, the contact portion 142 and the plural second clutch discs 143.

The shaft body 141 has a columnar shape and extends in the axial direction. The pinion 65*c* (see FIG. 3) is coupled to the lower end of the shaft body 141. The contact portion 142 outwardly extends from the shaft body 141. The contact portion 142 has an annular plate shape. The contact portion 142 is disposed beneath the thrust receiver 132*b* of the outer peripheral portion 132. The contact portion 142 is contacted to the lower surface of the thrust receiver 132*b*. The plural second clutch discs 143 respectively have an annular plate shape. The plural second clutch discs 143 are spline-coupled to the outer peripheral surface of the shaft body 141. The plural second clutch discs 143 are disposed at predetermined intervals in the axial direction. The second clutch discs 143 are interposed among the first clutch discs 133. In the present exemplary embodiment, seven second clutch discs 143 are provided. However, the number, the thickness and so forth of the second clutch discs 143 can be arbitrarily changed.

Detailed Construction of Outer Peripheral Portion 132

Figure 6:
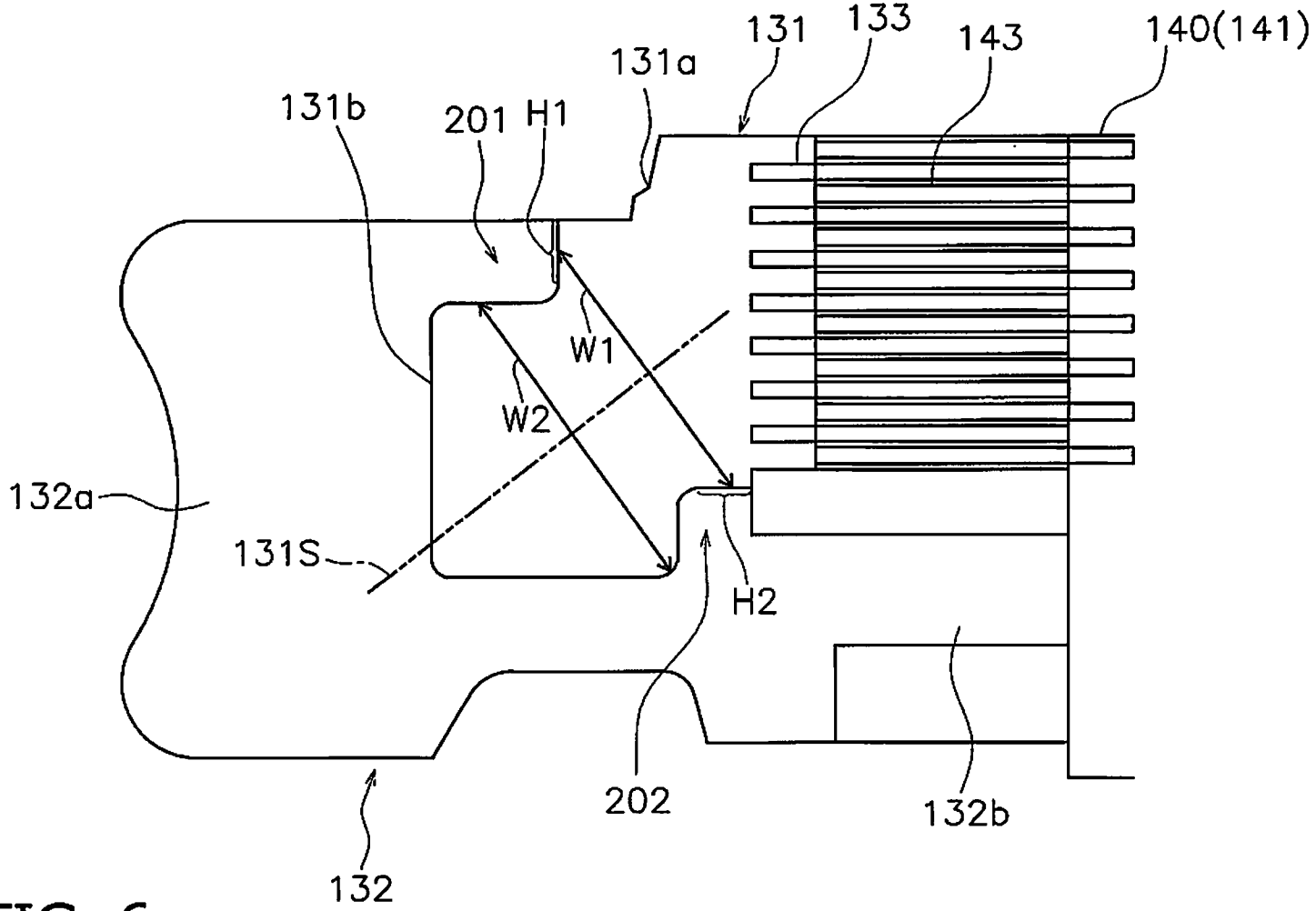
FIG. 6 is a cross-sectional view of an inner peripheral portion and an outer peripheral portion taken along a plane on which a center axis of a shaft passes.

FIG. 6 is a cross-sectional view of the inner peripheral portion 131 and the outer peripheral portion 132 taken along a plane on which the center axis AX of the shaft 140 passes.

As shown in FIG. 6, the outer peripheral portion 132 has a first part 201 and a second part 202.

The first part 201 covers the upper ends of the bulging parts 131*b* of the inner peripheral portion 131 from above. The first part 201 inwardly extends from the upper end of the outer peripheral portion body 132*a*. The second part 202 covers the lower ends of the bulging parts 131*b* of the inner peripheral portion 131 from inside. The second part 202 is formed by partially protruding the thrust receiver 132*b* upward.

The inner peripheral portion 131 has a first outer edge line H1 indicating the outer peripheral edge of the inner peripheral portion body 131*a* and a second outer edge line H2 indicating the lower edge of the inner peripheral portion body 131*a*. The first outer edge line H1 and the second outer edge line H2 are roughly symmetric to each other with respect to a reference line 131S that passes through the middle of the first outer edge line H1 and the second outer edge line H2.

A width W1 of the inner peripheral portion body 131*a* along a direction orthogonal to the reference line 131S gradually decreases toward the bulging parts 131*b*. On the other hand, a width W2 of each bulging part 131*b* along the direction orthogonal to the reference line 131S gradually increases oppositely to the inner peripheral portion body 131*a*, and thereafter, gradually decreases further oppositely to the inner peripheral portion body 131*a*.

The circle rotator 65*b* of the motor grader 100 includes the worm 120, the worm wheel 130 and the shaft 140. The worm wheel 130 includes the inner peripheral portion 131, the outer peripheral portion 132 that encloses the inner peripheral portion 131 from outside, and the plural first clutch discs 133 that are spline-coupled to the inner peripheral surface of the inner peripheral portion 131. The inner peripheral portion 131 is made of the material harder than the material of which the outer peripheral portion 132 is made.

Thus, the inner peripheral portion 131 is made of the hard material, and hence, surface pressure resistance can be enhanced for the contact surfaces of the first clutch discs and the inner peripheral portion to which the first clutch discs are spline-coupled. Therefore, the first clutch discs 133 can be reduced in thickness and in number. Hence, the circle rotator 65*b* can be reduced in entire height. As a result, the interval between the circle rotator 65*b* and the frame 10 can be extended, and thus, the range of rising motion of the blade 90 can be extended.

The outer peripheral portion 132 has the thrust receiver 132*b* to be disposed beneath the inner peripheral portion 131, whereas the shaft 140 has the contact portion 142 to be disposed beneath the thrust receiver 132*b*.

Therefore, the thrust receiver 132*b* made of the soft material is contacted to the contact portion 142 so as to be capable of receiving a thrust load. Hence, galling and adhesion of the contact portion 142 to the thrust receiver 132*b* can be inhibited. As a result, the circle rotator 65*b* can be smoothly driven.

The outer peripheral portion 132 has the first part 201 and the second part 202. The first part 201 covers the upper ends of the bulging parts 131*b* from above. The second part 202 covers the lower ends of the bulging parts 131*b* from inside.

Therefore, when the inner peripheral portion 132 is fixed to the interior of the mold and then the melting material is poured into the mold, a gap can be inhibited from being produced in the surrounding of the bulging parts 131*b*.

The width W1 of the inner peripheral portion body 131*a* along the direction orthogonal to the reference line 131S gradually decreases toward the bulging parts 131*b*. The width W2 of each bulging part 131*b* along the direction orthogonal to the reference line 131S gradually increases oppositely to the inner peripheral portion body 131*a*.

Thus, a binding force can be enhanced between the inner peripheral portion 131 and the outer peripheral portion 132 by narrowing the inner peripheral portion 131 at a boundary between the inner peripheral portion body 131*a* and the bulging parts 131*b*.

According to the present invention, the height of the circle rotator can be lowered. Hence, the present invention is useful in the field of motor graders.

The invention claimed is:

1. A motor grader, comprising:

a frame;

a drawbar disposed beneath the frame, the drawbar being supported by the frame and configured to pitch up and down;

a blade pivoting device supported by the drawbar; and a blade supported by the blade pivoting device, the blade pivoting device including a circle and a circle rotator, the circle supporting the blade and being rotatably attached to the drawbar, the circle rotator being configured to rotary drive the circle, the circle rotator including a worm, a worm wheel and a shaft, the worm wheel being meshed with the worm, the shaft being inserted through the worm wheel, the worm wheel including an inner peripheral portion, an outer peripheral portion, and a plurality of first clutch discs, the inner peripheral portion enclosing the shaft, the outer peripheral portion enclosing the inner peripheral portion from outside and being meshed with the worm, the plurality of first clutch discs being spline-coupled to an inner peripheral surface of the inner peripheral portion, the inner peripheral portion having an inner peripheral portion body and a bulging part, the inner peripheral portion body having an annular plate shape, the bulging part outwardly and downwardly bulging from the inner peripheral portion body, the inner peripheral portion made of a material harder than a material of which the outer peripheral portion is made, the outer peripheral portion having a first part and a second part, the first part covering an upper end of the bulging part from above, the second part covering a lower end of the bulging part from inside, and the shaft including a shaft body and a plurality of second clutch discs, the plurality of second clutch discs being spline-coupled to an outer peripheral surface of the shaft body and each being interposed between adjacent first clutch discs of the plurality of first clutch discs.

2. The motor grader according to claim 1, wherein on a cross-section of the inner peripheral portion taken along a plane on which a center axis of the shaft passes, a first outer edge line and a second outer edge line are approximately symmetric to each other with respect to a reference line, the first outer edge line indicating an outer peripheral edge of the inner peripheral portion body, the second outer edge line indicating a lower edge of the inner peripheral portion body, the reference line passing through a middle of the first outer edge line and the second outer edge line, a width of the inner peripheral portion body along a direction orthogonal to the reference line gradually decreases toward the bulging part, and a width of the bulging part along the direction orthogonal to the reference line gradually increases oppositely to the inner peripheral portion body.

3. The motor grader according to claim 1, wherein the inner peripheral portion is made of cast iron.

4. The motor grader according to claim 1, wherein the outer peripheral portion is made of copper-aluminum alloy.

5. A motor grader, comprising:

a frame;

a drawbar disposed beneath the frame, the drawbar being supported by the frame and configured to pitch up and down;

a blade pivoting device supported by the drawbar; and a blade supported by the blade pivoting device, the blade pivoting device including a circle and a circle rotator, the circle supporting the blade and being rotatable attached to the drawbar, the circle rotator being configured to rotary drive the circle, the circle rotator including a worm, a worm wheel and a shaft, the worm wheel being meshed with the worm, the shaft being inserted through the worm wheel, the worm wheel including an inner peripheral portion, an outer peripheral portion, and a plurality of first clutch discs, the inner peripheral portion enclosing the shaft, the outer peripheral portion enclosing the inner peripheral portion from outside and being meshed with the worm, the plurality of first clutch discs being spline-coupled to an inner peripheral surface of the inner peripheral portion, the inner peripheral portion being made of a material harder than a material of which the outer peripheral portion is made, the outer peripheral portion having an outer peripheral portion body and a thrust receiver, the outer peripheral portion body enclosing the inner peripheral portion from outside, the thrust receiver inwardly extending from the outer peripheral portion body and being disposed beneath the inner peripheral portion, the shaft including a shaft body, a contact portion, and a plurality of second clutch discs, the contact portion outwardly extending from the shaft body and being disposed beneath the thrust receiver, the plurality of second clutch discs being spline-coupled to an outer peripheral surface of the shaft body and each being interposed between adjacent first clutch discs of the plurality of first clutch discs.

6. The motor grader according to claim 5, wherein the inner peripheral portion has an inner peripheral portion body and a bulging part, the inner peripheral portion body having an annular plate shape, the bulging part outwardly and downwardly bulging from the inner peripheral portion body, and the outer peripheral portion has a first part and a second part, the first part covering an upper end of the bulging part from above, the second part covering a lower end of the bulging part from inside.

7. The motor grader according to claim 6, wherein on a cross-section of the inner peripheral portion taken along a plane on which a center axis of the shaft passes, a first outer edge line and a second outer edge line are approximately symmetric to each other with respect to a reference line, the first outer edge line indicating an outer peripheral edge of the inner peripheral portion body, the second outer edge line indicating a lower edge of the inner peripheral portion body, the reference line passing through a middle of the first outer edge line and the second outer edge line, a width of the inner peripheral portion body along a direction orthogonal to the reference line gradually decreases toward the bulging part, and a width of the bulging part along the direction orthogonal to the reference line gradually increases oppositely to the inner peripheral portion body.

8. The motor grader according to claim 7, wherein the inner peripheral portion is made of cast iron.

9. The motor grader according to claim 8, wherein the outer peripheral portion is made of copper-aluminum alloy.

10. A motor grader, comprising:

a frame;

a drawbar disposed beneath the frame in a vertical direction of the motor grader, the drawbar being supported by the frame and configured to pitch up and down;

a blade pivoting device supported by the drawbar; and a blade supported by the blade pivoting device, the blade pivoting device including a circle and a circle rotator, the circle supporting the blade and being rotatably attached to the drawbar, the circle rotator being configured to rotary drive the circle, the circle rotator including a worm, a worm wheel and a shaft, the worm wheel being meshed with the worm, the shaft being inserted through the worm wheel, a longitudinal center axis of the shaft extending in the vertical direction of the motor grader, the worm wheel including an inner peripheral portion, an outer peripheral portion, and a plurality of first clutch discs, the inner peripheral portion enclosing the shaft, the outer peripheral portion enclosing the inner peripheral portion from outside and being meshed with the worm, the plurality of first clutch discs being spline-coupled to an inner peripheral surface of the inner peripheral portion, the inner peripheral portion and the outer peripheral portion being made of different materials, the outer peripheral portion having an outer peripheral portion body and a thrust receiver, the outer peripheral portion body enclosing the inner peripheral portion from outside, the thrust receiver extending radially inward toward the shaft from the outer peripheral portion body and being disposed beneath the inner peripheral portion in the vertical direction of the motor grader, the shaft including a shaft body, a contact portion, and a plurality of second clutch discs, the contact portion extending radially outward from the shaft body and being disposed beneath the thrust receiver such that the thrust receiver and the contact portion overlap each other, the plurality of second clutch discs being spline-coupled to an outer peripheral surface of the shaft body and each being interposed between adjacent first clutch discs of the plurality of first clutch discs.

11. The motor grader according to claim 10, wherein the inner peripheral portion made of a material harder than a material of which the outer peripheral portion is made.

* * * * *